United States Patent [19]

Watts

[11] Patent Number: 5,020,672

[45] Date of Patent: Jun. 4, 1991

[54] BASKET GRASS CONTAINER

[76] Inventor: Lucille M. Watts, 11 Ray Way, Las Vegas, Nev. 89124

[21] Appl. No.: 470,891

[22] Filed: Jan. 26, 1990

[51] Int. Cl.[5] ..... B65D 85/52

[52] U.S. Cl. ..... 206/575; 206/423; 206/521.1; 217/123

[58] Field of Search ..... 206/388, 423, 83.5, 206/521.1, 457, 575, 223; 217/123, 124; 220/212, 23, 315

[56] References Cited

U.S. PATENT DOCUMENTS

| | | | |
|---|---|---|---|
| 206,976 | 8/1878 | Sands | 206/83.5 |
| 340,769 | 4/1886 | Davenport | 206/83.5 |
| 443,620 | 12/1890 | Orr | 206/83.5 |
| 2,135,955 | 11/1938 | Woodall | 217/124 |
| 2,199,114 | 4/1940 | Rosenberg | 206/83.5 |
| 2,657,158 | 10/1953 | Gerard | 154/54 |
| 3,249,140 | 5/1966 | Jackson | 206/423 |
| 3,820,653 | 6/1974 | Shaw et al. | 206/388 X |
| 4,098,405 | 7/1978 | Botvin | 206/527 |
| 4,235,065 | 11/1980 | Freeman | 53/472 |
| 4,292,266 | 11/1981 | Weder | 264/140 |
| 4,384,604 | 5/1983 | DeLaura et al. | 206/423 |
| 4,514,453 | 4/1985 | Bussey, Jr. | 428/159 |
| 4,602,664 | 7/1986 | Hullen | 206/83.5 X |

*Primary Examiner*—Jimmy G. Foster
*Assistant Examiner*—Jacob K. Ackun, Jr.
*Attorney, Agent, or Firm*—Quirk, Tratos & Roethel

[57] ABSTRACT

A mesh container holds plastic synthetic grass strips that are used to form a support cushion for candy and other items in an Easter basket. The mesh size is selected to be of the appropriate gauge to minimize the possibility of the grass strips from falling out of the mesh container. The flatness or thickness of the container can be varied.

14 Claims, 3 Drawing Sheets

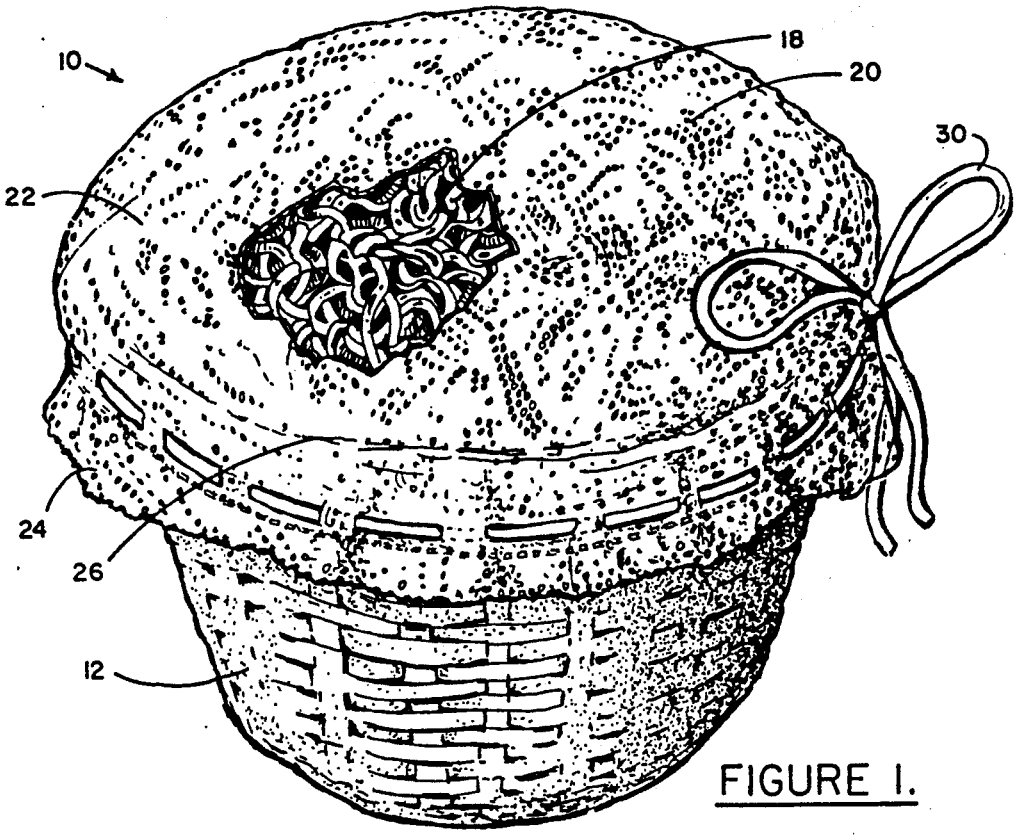
FIGURE 1.
FIGURE 2.
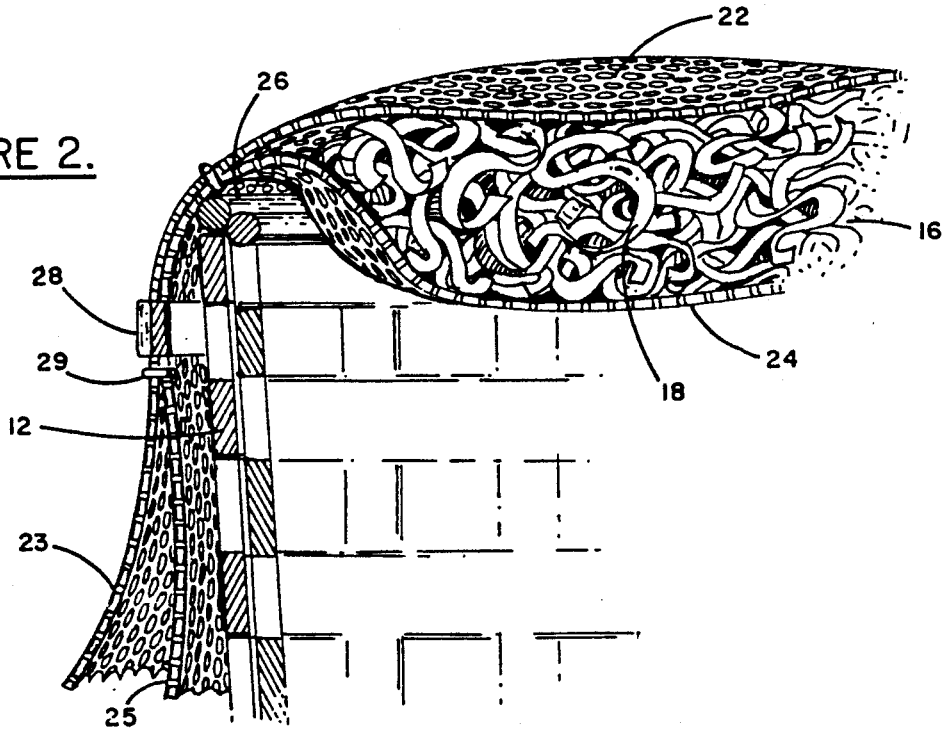

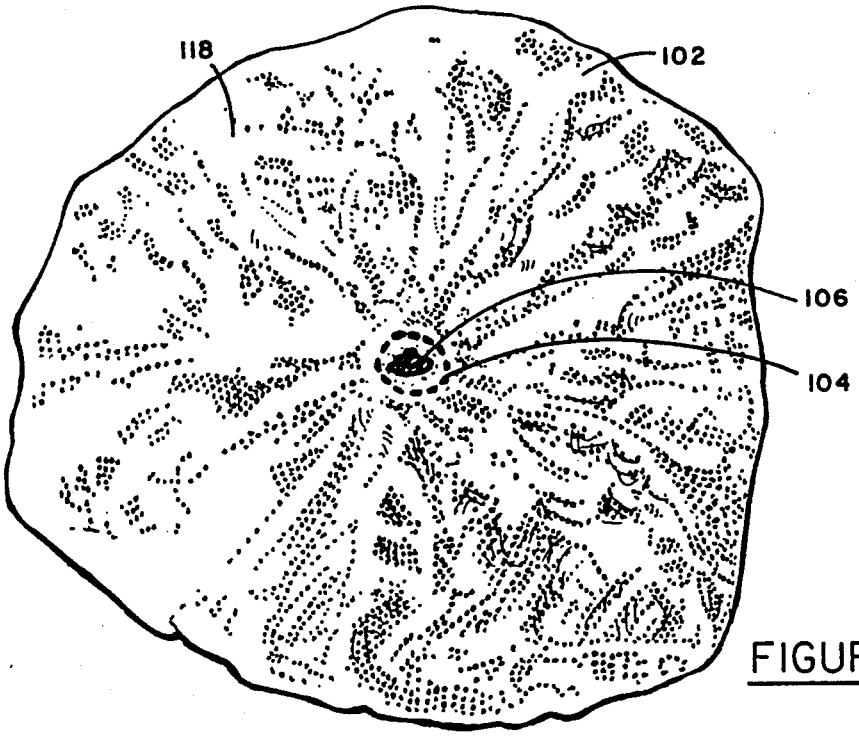
FIGURE 5.
FIGURE 6.
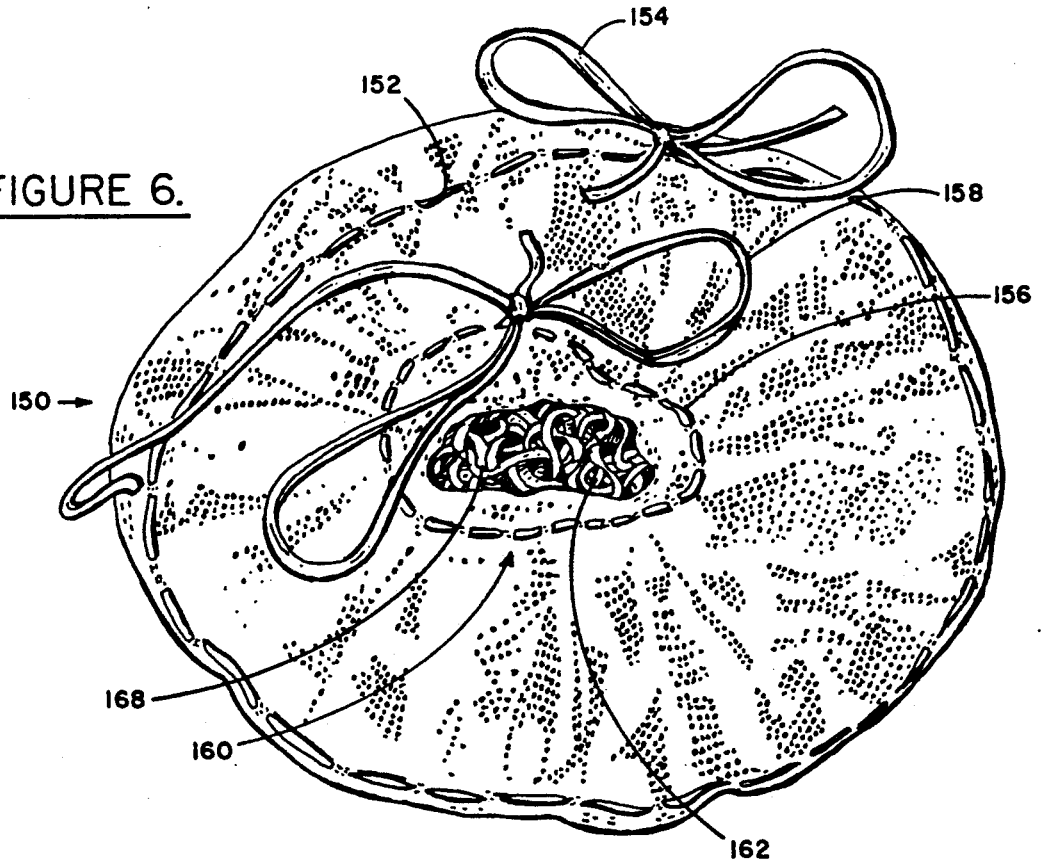

BASKET GRASS CONTAINER

This invention relates to a basket grass container, and more particularly to a basket grass container designed for use during Easter time and the other holiday seasons.

BACKGROUND OF THE INVENTION

During the Easter holiday season, it has become common practice to provide for children and children-at-heart an Easter basket filled with chocolate bunnies, candy eggs, jelly beans and other chocolate and sugary candies and confections. In years gone by, natural grass served as the supporting material for the candy. In more modern times, the Easter basket is filled with colored strips of plastic synthetic material that imitates natural grass and forms the base upon which the Easter candy is placed. This cushions the candy to prevent it from becoming broken and provides a suitable container for transporting the candy.

Typical of the plastic synthetic grass strips that are used in Easter baskets and for other decorative purposes are those shown in the patent to Weder et al. (U.S. Pat. No. 4,292,266), the disclosure of which is incorporated herein by this reference.

One of the drawbacks from the use of plastic synthetic grass strips is that the grass strips are loosely placed in the basket and can be quite messy. The plastic synthetic grass is generally formed in thin, narrow strips or varying lengths. During the use of the basket, these grass strips become separated from the basket and often are left behind on table tops, furniture, floors and other surfaces throughout the house. Being particularly light and often made of colored material, they are difficult to pick up. Even using mechanical means to clean up the resulting mess runs the risk of fouling the internal workings of the vacuum cleaner.

For small children and house pets, there is the danger that these grass strips may be ingested risking the possibility of serious bodily injury. Because the grass strips are made from synthetic material, there is always the possibility that the grass strips will become attached to the candy, especially is the candy begins to melt which may happen at room temperature.

Also, each new holiday season necessitates repurchasing another supply of grass strips for use in the Easter baskets because there has been no convenient way to store the grass strips for reuse.

It is an object of this invention to provide a container for grass strips used in Easter baskets to keep the grass strips inside the basket and separated physically from the candy to minimize the possibility of inadvertent ingestion of the grass strips and to minimize the grass strips from being strewn around the house.

It is a feature of the present invention to utilize a mesh container to hold the grass strips. The mesh container can be sized to fit various size baskets and will be flexible to conform to various interior shapes of the basket.

It is an advantage of the present invention that the grass strips that are used in Easter baskets are contained in a mesh container that holds the grass strips inside the basket, allows for easy storage and reuse of the grass strips and both minimizes the possibility of inadvertent ingestion by children and minimizes the strewing of the grass strips about the house.

SUMMARY OF THE INVENTION

A mesh container holds plastic synthetic grass strips that are used to form a support cushion for candy and other items in an Easter basket. The mesh size is selected to be of the appropriate gauge to minimize the possibility of the grass strips from falling out of the mesh container. The mesh container can be filled with grass strips and then permanently sealed around its circumference to prevent access to the grass strips. Alternatively, the mesh container can be provided with a drawstring or other non-permanent sealing means to allow selective access to the inside of the container to permit the addition or subtraction of the amount of grass strips that are inside the mesh container to accommodate different size baskets.

BRIEF DESCRIPTION OF THE DRAWINGS

FIG. 1 shows a perspective view of the basket grass container of the present invention.

FIG. 2 shows a partial cutaway section of the basket grass container of FIG. 1.

FIG. 5 shows a bottom view of the alternative embodiment of the basket grass container of FIG. 4.

FIG. 6 shows a bottom view of yet another alternative embodiment of the basket grass container of the present invention.

DETAILED DESCRIPTION OF THE PREFERRED EMBODIMENTS

Figure 3:
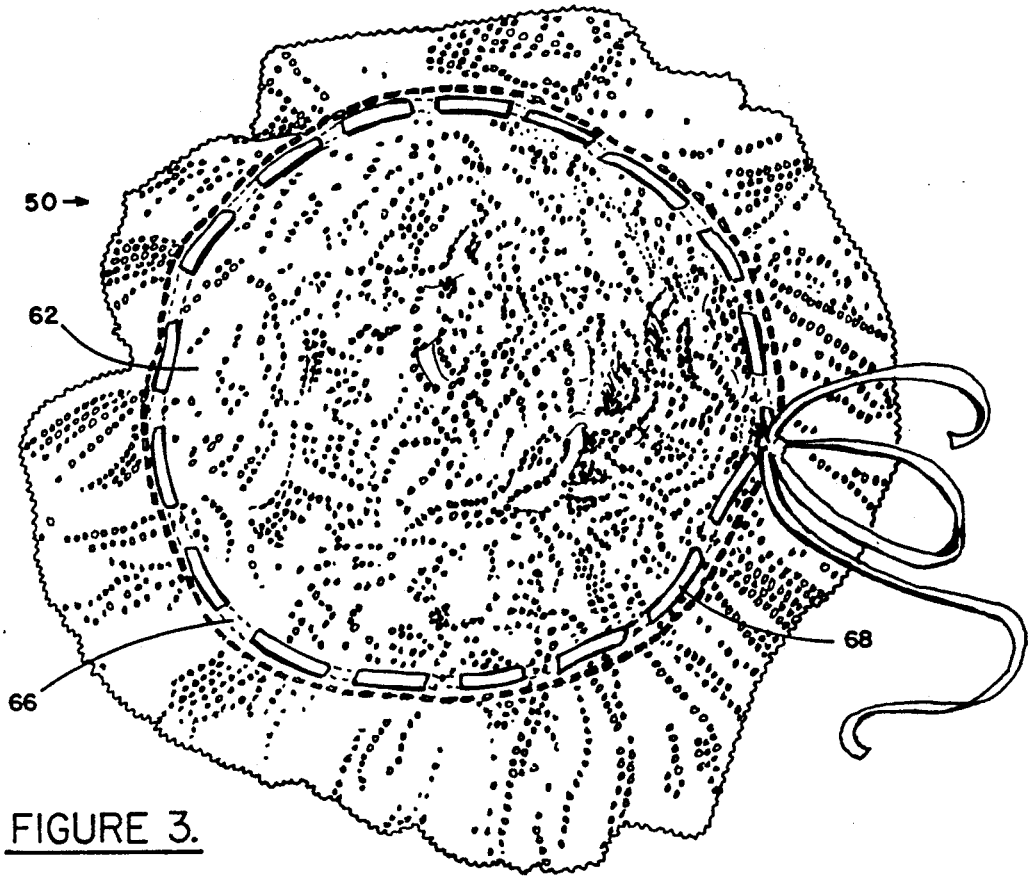
FIG. 3 shows a top view of an alternative embodiment of the basket grass container of the present invention.

The present invention is shown generally at 10 in FIG. 1. The basket grass container 20 holds a plurality of small pieces of grass strips 18. These grass strips 18 can be made of any suitable material such as synthetic plastics, scrap plastic material, cellophane, paper and the like. Typical of the grass strips 18 that can be used in the present invention are those disclosed in U.S. Pat. No. 4,292,266 (Weder et al.).

The basket grass container 20 that holds the grass strips 18 is comprised of a mesh material which can also be made from synthetic plastics. The size of the interstices of the mesh material is chosen so that the grass strips 18 will remain inside the mesh material. As shown in FIGS. 1 and 2, the container 20 has a first generally circular sheet 22 of mesh material that forms the top of the container 20 and a second generally circular sheet 24 of mesh material that forms the bottom of the container 20. The top mesh sheet 22 is joined to the bottom mesh sheet 24 along a generally circular line 26 that corresponds to the perimeter of the top of the basket 12. The joining of the top mesh sheet 22 to the bottom mesh sheet 24 can be accomplished in any suitable manner, although the preferred way is by sewing using a suitable thread.

The basket 12 can be a conventional woven basket being generally frusto-conical in cross-section. The basket can be made from the usual wicker material, but may also be made from any other appropriate material such as wood, metal or plastic.

By joining the top mesh sheet 22 to the bottom mesh sheet 24 along circular line 26, an internal cavity 16 is created between the top mesh sheet 22 and the bottom mesh sheet 24. This cavity 16 is filled with the grass strips 18 which creates the cushion and support for the candy or other items that will eventually be placed in the basket.

Both the top mesh sheet 22 and the bottom mesh sheet 24 have edges that extend beyond circular line 26 where the sheets are joined together. The edge 23 of the top mesh sheet 22 overlaps with the edge 25 of the bottom mesh sheet 24 as shown in detail in FIG. 2. Adjacent to the circular line 26, a ribbon 28 is interwoven through the interstices in the top mesh sheet 22 and the bottom mesh sheet 24. This creates an intermediate portion between the circular line 26 and the ribbon 28 which places the ribbon below the rim of the basket 12. When the ends of the ribbon are grasped and drawn together, the combined top and bottom mesh sheets will be pulled tighter around the upper part of the basket 12. This will secure the basket grass container 20 to the basket 12. The ends of the ribbon 28 can be tied in any suitable manner, such as in a bow 30 as shown in FIG. 1.

As shown in FIG. 3, a top view of an alternative embodiment of the present invention is shown in which the basket grass container 50 can be modified so that the circular joining line 66 joining the top mesh sheet 62 and the bottom mesh sheet (not shown) coincides with the interwoven ribbon 68. In such an arrangement, there is no intermediate portion that hangs below the upper rim of the basket. This embodiment is used when it is not necessary or desirable to secure the basket grass container to the basket. By tightening or loosening the ribbon, the size of the internal cavity between the top mesh sheet 62 and the bottom mesh sheet can be thicker or flatter, respectively.

Figure 4:
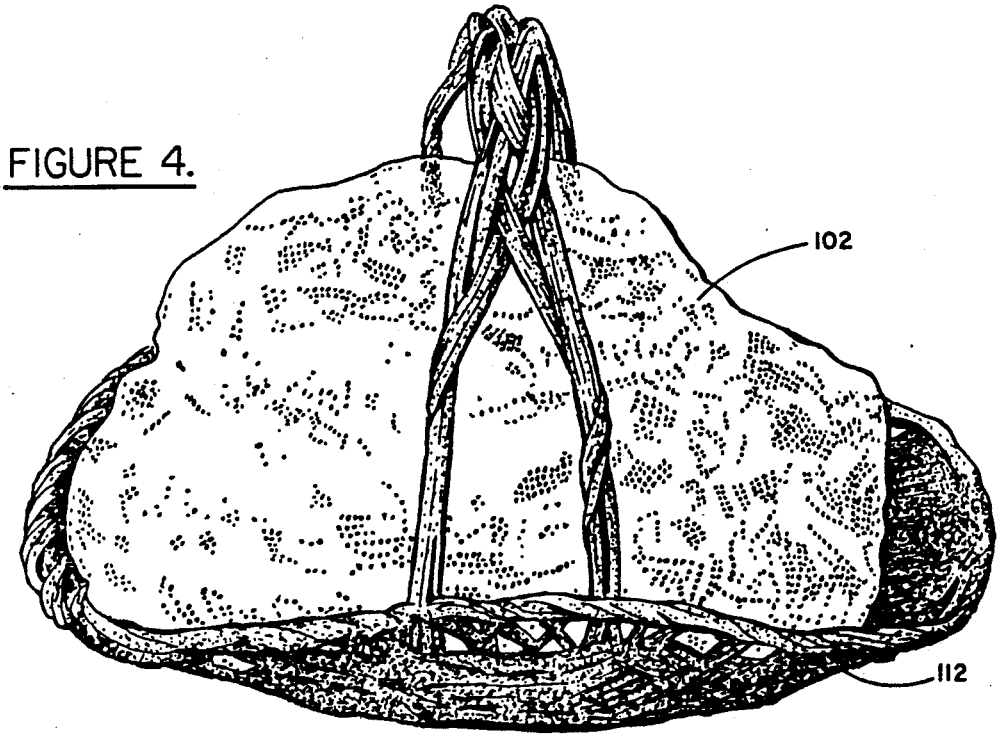
FIG. 4 shows a perspective view of another alternative embodiment of the basket grass container of the present invention.

FIGS. 4 and 5 show another alternative embodiment of the present invention designed to accommodate baskets of irregular dimensions or baskets that have handles which would interfere with the container 12 shown in FIG. 1 from being able to be pulled tightly around the upper portion of the basket. The mesh sheet 102 of this embodiment is generally circular with its edges gathered together at a central location 104. The edges are permanently joined together in any suitable manner, preferably by sewing using a suitable thread. The interior cavity of the container 102 is filled with grass strips 118 to the appropriate or desired density. The resulting container 102 is quite flexible and can be easily configured by hand to achieve the desired shape to conform to the interior of the basket 112 in which it is placed a shown in FIG. 4. The grass strip container 102 can be placed into a basket 112 with the central location on the bottom side of the container 102 so that the joining or sewing does not interfere with the aesthetics of the container 102 and basket 112.

It may be desirable to leave a small aperture 106 at the location at which the ends of the mesh sheet 102 are gathered to allow grass strips to be inserted or removed from the cavity to vary the density of the grass strip container 102 depending on the size of the basket 112 into which it will be placed, but the aperture 106 should be made small enough so that the grass strips contained inside the cavity cannot fall out inadvertently.

FIG. 6 shows yet another embodiment of the present invention in which two ribbons are used. A single mesh sheet having a generally circular configuration is used and the ends of the mesh sheet are gathered at a central location 160. The outer ribbon 152 is interwoven through the mesh material at approximately the equator of the resulting container 150. Grass strips 168 are placed inside the container 150. By loosening or tightening the outer ribbon 152, the flatness or thickness of the container can be varied. The ends of the outer ribbon 152 can be tied together in any appropriate form such as the bow 154.

An inner ribbon 156 is interwoven throughout the interstices of the mesh material at a location adjacent the gathering point of the ends of the mesh sheet. By loosening or tightening the inner ribbon 156, the size of the aperture 162 at the central location can be made larger or smaller. This allows the grass strips 168 to be inserted or removed from the container 150 to vary the size and density of the container 150. The aperture 162 can be completely closed by pulling tight the ends of the inner ribbon 156 The ends of the inner ribbon 156 can be tied together in any appropriate form such as the bow 158.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A container for holding grass strips for use in a basket comprising:

(a) a first mesh sheet, (b) a second mesh sheet, (c) means for joining the periphery of the first mesh sheet against the periphery of the second mesh sheet to form an internal cavity therebetween, said first mesh sheet directly overlying the second mesh sheet beyond the joining means to constitute a marginal edge spaced from said joining means and said cavity, (d) a plurality of grass strips contained in the internal cavity, and (e) means interwoven through interstices in the mesh sheets and extending around the peripheral edges of the mesh sheets for adjusting the size of the internal cavity whereby the container can be made either flatter or thicker as desired.

2. The container of claim 1 wherein the first mesh sheet and the second mesh sheet are generally circular in cross-section.

3. The container of claim 1 wherein the means for joining is a thread sewn to join the top mesh sheet and the bottom mesh sheet.

4. The container of claim 1 wherein the means for adjusting is a ribbon.

5. The container of claim 4 wherein the ends of the ribbon are tied in a bow.

6. A container for holding grass strips for use in a basket comprising:

(a) a first mesh sheet having a generally circular cross-section, (b) a second mesh sheet having a generally circular cross-section, (c) a thread joining the peripheral edges of the first mesh sheet and the second mesh sheet to form an internal cavity therebetween, (d) a plurality of grass strips contained in the internal cavity, and (e) a ribbon interwoven between the interstices of the top mesh sheet and the bottom mesh sheet and extending around the peripheral edges of the mesh sheets whereby the size of the internal cavity can be made either flatter or thicker as desired.

7. The container of claim 6 wherein the ends of the ribbon are tied in a bow.

8. In combination with a basket, a container for holding grass strips for use in the basket comprising:

(a) a first mesh sheet, (b) a second mesh sheet, (c) means for joining the peripheral edges of the first mesh sheet and the second mesh sheet to form an internal cavity therebetween, (d) a plurality of grass strips contained in the internal cavity, and (e) means for adjusting the size of the internal cavity whereby the container can be made either flatter or thicker as desired.

9. The combination of claim 8 wherein the first mesh sheet and the second mesh sheet are generally circular in cross-section.

10. The combination of claim 8 wherein the means for joining is a thread sewn to join the top mesh sheet and the bottom mesh sheet.

11. The combination of claim 8 wherein the means for adjusting is a ribbon interwoven between the interstices of the top mesh strip and the bottom mesh strip.

12. The combination of claim 11 wherein the ends of the ribbon are tied in a bow.

13. In combination with a basket, a container for holding grass strips for use in the basket comprising:

(a) a first mesh sheet having a generally circular cross-section, (b) a second mesh sheet having a generally circular cross-section, (c) a thread joining the peripheral edges of the first mesh sheet and the second mesh sheet to form an internal cavity therebetween, (d) a plurality of grass strips contained in the internal cavity, and (e) a ribbon interwoven between the interstices of the top mesh sheet and the bottom mesh sheet whereby the size of the internal cavity can be made either flatter or thicker as desired.

14. The combination of claim 13 wherein the ends of the ribbon are tied in a bow.

* * * * *